United States Patent [19]

Richards

[11] 4,012,544

[45] Mar. 15, 1977

[54] DUST COLLECTION MAT AND METHOD OF MANUFACTURE

[75] Inventor: Ernest Levon Richards, LaGrange, Ga.

[73] Assignee: Milliken Research Corporation, Spartanburg, S.C.

[22] Filed: June 12, 1975

[21] Appl. No.: 586,154

[52] U.S. Cl. ..... 428/95; 24/73 HH; 24/201 HH; 24/230.5 AD; 24/DIG. 18; 428/99; 428/100; 428/223

[51] Int. Cl.[2] ..... D03D 27/00; D04H 11/00

[58] Field of Search ..... 428/95, 99, 100, 223; 24/73 HH, 73 HR, 90 C, 201 HH, 230.5 AD, DIG. 18

[56] References Cited

UNITED STATES PATENTS

| | | | |
|---|---|---|---|
| 2,016,876 | 10/1935 | Stolzenberg | 428/99 |
| 2,717,437 | 9/1955 | Mestral | 428/95 |
| 2,976,914 | 3/1961 | Miller | 428/99 |
| 3,306,808 | 2/1967 | Thompson | 428/95 |
| 3,583,890 | 6/1971 | Kolckmann | 428/95 |

FOREIGN PATENTS OR APPLICATIONS

| | | |
|---|---|---|
| 1,124,292 | 1968 | United Kingdom |

*Primary Examiner*—Marion E. McCamish
*Attorney, Agent, or Firm*—H. William Petry; Earle R. Marden

[57] ABSTRACT

A no creep dust collection mat having a laminated rubber backing which has a plurality of spaced sections of hook accommodating material projecting therethrough to accommodate an attaching member which secures the mat in a relatively fixed position on a carpeted floor.

2 Claims, 7 Drawing Figures

DUST COLLECTION MAT AND METHOD OF MANUFACTURE

Small area rugs, scatter rugs, and entrance mats which are placed upon a carpeted surface tend to slowly move across the surface of the carpet when the mats are walked upon. This movement is a nuisance since the mat may have to be replaced in its desired location several times per day. This problem is especially difficult to solve in the case of sheet-rubber backed mats which are used in the rental laundry business, because these mats are subjected to very severe washing conditions which often include treatment with a mineral oil based dust control compound. These repeated severe wash-treat cycles usually cause early failure of any adhesive or other method of attachment of any device used to restrict the movement of the mat upon the carpeted surface.

It is therefore an object of the invention to provide a dust collection mat which will not creep when placed in position on a carpeted surface.

Figure 2:
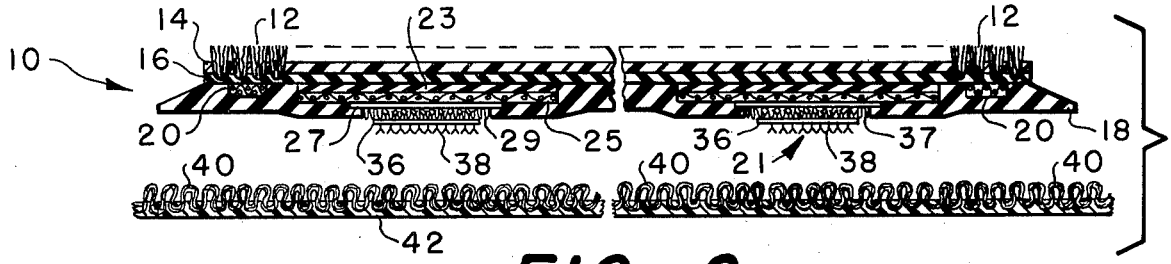
FIG. 2 is a section view taken on line 2—2 of FIG. 1.
Figure 1:
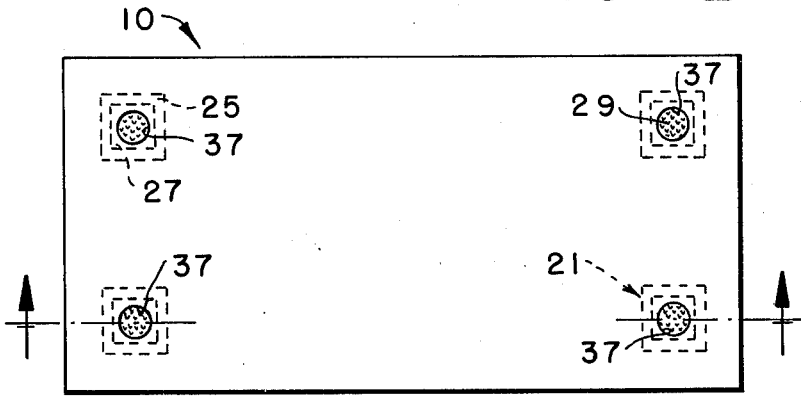
FIG. 1 is a schematic top view of the new and novel no creep dust control mat.
Figure 3:
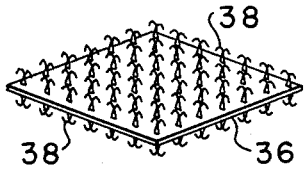
FIG. 3 is a perspective view of the preferred fastener used in conjunction with the mat.
Figure 4:
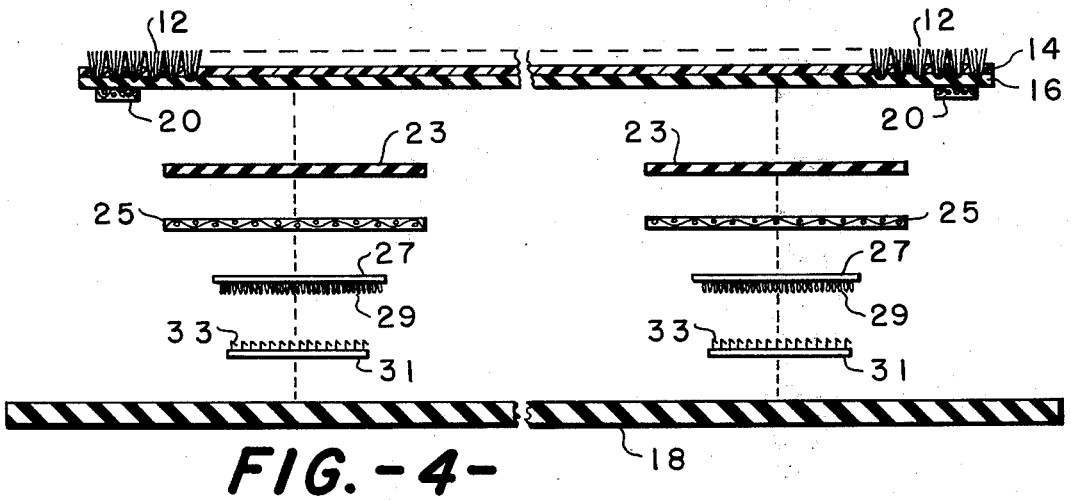
FIG. 4 is an exploded view of the dust control mat prior to autoclaving.

FIGS. 1 and 2 show views of the improved dust control mat 10 which comprises tufts of yarn 12 tufted into a non-woven fabric 14 and held therein by a tie-coat 16 of suitable latex material such as Neoprene. Laminated to the bottom of the tie-coat 16 is a cured, calendered rubber backing sheet 18. To prevent and lessen the tendency of the mat 10, and in particular the rubber backing sheet 18, from tearing a narrow elongated anti-tear strip 20 is located between the tie-coat 16 and the rubber backing sheet 18 in a direction substantially perpendicular to the grain of the rubber backing sheet 18.

Generally, to produce the mat, the pile yarns of the subject mat are tufted into a non-woven fabric capable of withstanding the forces of tufting and subsequently holding the yarns in place as the pile fabric is pre-coated with a tie coat, for example, chloroprene latex such as duPont's Neoprene, and dried. (The functions of the pre-coat are to bind the fibers of the backstitch together and to promote laminar adhesion of the fabric component with a calendered rubber backing.) After pre-coating, the fabric is cut to desired size and shape and placed in a mold where uncured calendered rubber stock is placed on top of the pre-coated back of the mat. Thereafter, a vacuum is created under the rubber to produce intimate contact with the pre-coated side of the textile component. This vacuum also prevents water vapors from remaining in or entering the assembly during subsequent curing of the rubber which would reduce the development of laminar adhesion between the rubber and the pre-coated textile. After the vacuum has been established, the assembly is placed in an autoclave where superheated steam is maintained at a pressure of about 70 PSIG for about 20–27 minutes to cure the rubber. Thereafter, the steam in the autoclave is released, the autoclave door is opened, the vacuum is released and the mats are removed, cooled and the rubber edges are trimmed to produce a border around each mat.

Figure 5:
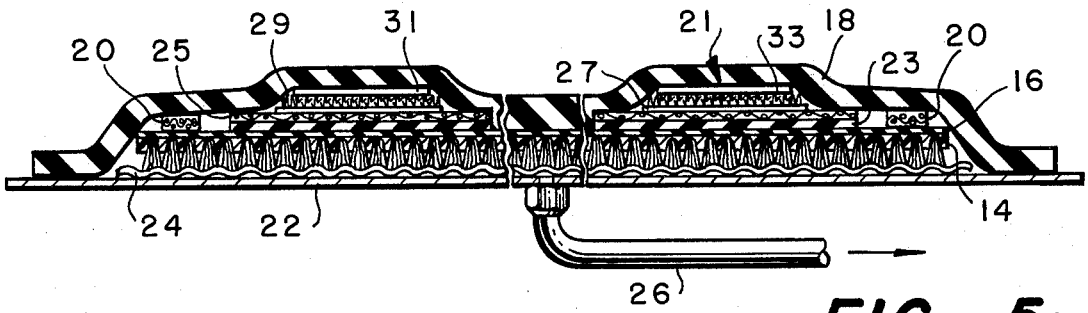
FIG. 5 is a cross-section view of the pre-coated, pre-cut mat fabric located in a platen or vacuum mold and covered with a sheet of rubber stock when a vacuum has been applied.

Now looking at the invention in detail the pre-coated and pre-cut fabric, consisting of tufts 12, non-woven fabric 14 and tie-coat 16, is centered on a vacuum mold consisting of plate 22 and non-uniform undulated plate 24 as shown in FIG. 5. Then a sheet of calendered rubber stock 18 of predetermined width and length is placed on the above-mentioned fabric. Then, preferably the ends of the rubber sheet 18 are laid back to expose the leading edges of the tie-coat 16 and the anti-tear strips 20 and the carpet securing patches 21 are placed into position. In the preferred form of the invention, the tear strips 20 are placed in a position substantially perpendicular to the calendered direction of the rubber sheet 18 while the patches 21 are located at the four corners of the mat.

The carpet securing patches 21, preferably, consist of a layer 23 of rubber stock, a woven or knitted reinforcing strip 25, a piece of textile or other material 27 having a plurality of loops 29 facing away from the reinforcing strip and a piece of fabric 31 having hooks 33 on one side thereof engaging the loops 29 while the other side of the fabric 31 is selected of a material or coated with a material which does not adhere to the rubber stock 18. In the preferred form of the invention the layer 23 is used to promote adhesion to the primary backing 16 and the rubber backing 18, but it is within the scope of the invention to coat the reinforcing fabric 25 with an adhesion promoting latex, such as resorcinol-formaldehyde and eliminate the layer 23. Also, if desired, the material 27 can be sewn to the reinforcing strip 25 to maintain the relative position of each to each other.

Figure 6:
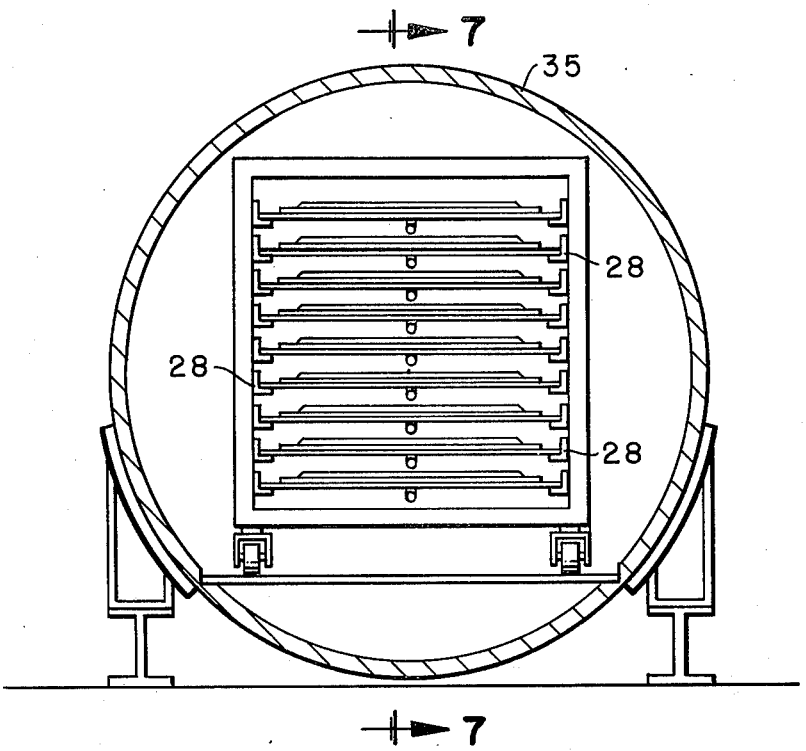
FIG. 6 is a cross-section view of an autoclave with a plurality of vacuum molds located therein.
Figure 7:
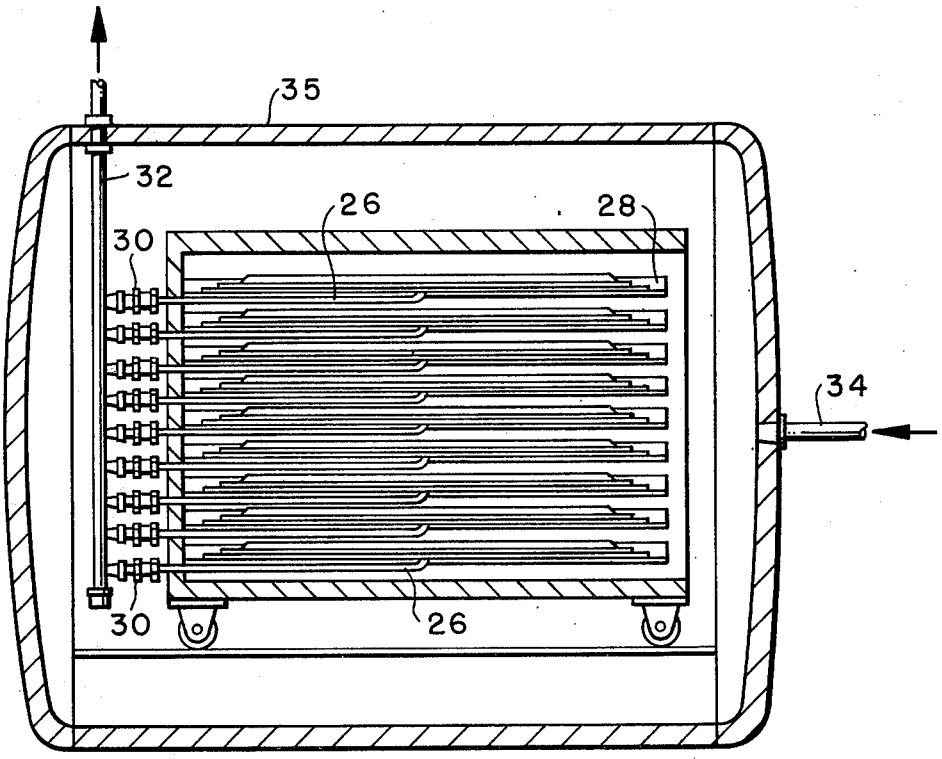
FIG. 7 is a cross-section view taken on line 7—7 of FIG. 6.

Then the leading edges of the rubber sheet are replaced so that when a vacuum is sucked thru conduit 26 the rubber sheet 18 will assume the shape shown in FIG. 5 to seal the mold. Then a plurality of loaded molds are placed on brackets 28 into the autoclave 35 (FIGS. 6 and 7) with the suction connections 30 connected to the suction manifold 32. Then a suction pressure is applied to the suction manifold 32 to evacuate the molds and pull the rubber sheets 18 down into sealing relationship with the plates 22. Then, while the vacuum is maintained in the molds, the door to the autoclave 35 is closed, and steam at a pressure of about 70 PSIG is injected through conduit 34 into the autoclave 35 and the autoclave is maintained at such steam pressure for about 20–27 minutes until the rubber sheet 18 is cured. Thereafter, the steam is released, the autoclave opened, the vacuum pressure released and the mats are removed from the mold. Then the mats are cooled and trimmed at that portion 37 of the rubber sheet 18 adjacent the loops 29 of the material 27 is cut away to expose the loops 29 to provide a mat that can be employed on a carpeted or uncarpeted surface.

If it is desired to use the mat 10 on an uncarpeted floor, the mat can be merely placed into position or, if desired, the fabric 31 can be removed and then placed in position. When it is desired to use the disclosed mat on a carpeted floor, as schematically indicated in FIG. 2, the pieces of fabric 31 are removed and the double-hooked members 36 are placed in each of the areas 37.

The members 36 have hooks 38 on both sides so that the hooks on the upper side will engage the loops 29 of the material 27 and the hooks on the other side will engage the loops 40 of the carpet 42 to secure the mat in a fixed position thereon thereby preventing the mat from creeping once placed into position.

It can readily be seen that a mat construction has been disclosed which can be readily employed on an uncarpeted floor but at the same time can be used on a carpeted floor and will not creep like prior art mats.

Although the specific embodiment of the invention has been described, it is contemplated that changes may be made without departing from the scope or spirit of the invention and it is desired that the invention be limited only by the claims.

That which is claimed is:

1. In combination with a mat having a rubber backing material and a carpet, said rubber backing material having a plurality of openings therein, the improvement comprising a looped fabric located in said openings and a double hooked member having the hooks on one side engaging said looped fabric and the hooks on the other side engaging said carpet to prevent said mat from creeping on said carpet.

2. A mat comprising: a sheet of textile material, a plurality of tufts of yarn connected thereto, a rubber backing material laminated to said sheet of textile material, a plurality of openings in said rubber backing material, a looped fabric located in said openings between said sheet of textile material and said rubber backing material and double hooked member having the hooks on one side engaging said looped fabric and the hooks on the other side adapted to engage a carpet-like material.

* * * * *